United States Patent [19]

Lock et al.

[11] 4,074,610

[45] Feb. 21, 1978

[54] AUTOMATED AMMUNITION LOADING/DOWNLOADING SYSTEM

[76] Inventors: William E. Lock, 183 Wygant Road, Horseheads, N.Y. 14845; Charles J. Churillo, 221 Gilda Place, Fort Walton Beach, Fla. 32548

[21] Appl. No.: 697,662

[22] Filed: June 18, 1976

[51] Int. Cl.[2] ..... F41F 9/02

[52] U.S. Cl. ..... 89/34; 209/97

[58] Field of Search ..... 89/34; 198/426, 472, 198/484; 209/83, 97

[56] References Cited

U.S. PATENT DOCUMENTS 3,696,704 10/1972 Backus et al. ..... 89/34

*Primary Examiner*—Stephen C. Bentley

*Attorney, Agent, or Firm*—Joseph E. Rusz; Arsen Tashjian

[57] ABSTRACT

A system which automatically: removes rounds of ammunition from their presently-existing standardized ammunition shipping/storage container; transfers the removed rounds and loads them into an aircraft system for use; separates the returning downloaded spent cases from the returning unfired rounds; and, repackages the unfired rounds back into shipping/storage containers. The system includes: an ammunition trailer on which are carried the filled shipping/storage containers of unfired rounds of ammunition; a loader assembly which is the major component of the system and onto which the containers of ammunition are loaded; flexible chuting that houses ammunition round-conveyor elements and that is attached at one and to the loader assembly; and, a loader/aircraft interface unit which is attached at one end to the other end of the flexible chuting, and is attached at the other end to the aircraft and the aircraft gun system for use of the rounds of ammunition. Unlike the prior art, this system eliminates the need for any type of "linking" of the rounds of ammunition (by clips, links, belts and the like); uses existing standardized ammunition shipping/storage containers; and, utilizes the force of gravity to significantly reduce, and thereby minimize, power requirements.

6 Claims, 20 Drawing Figures

FIG. 12
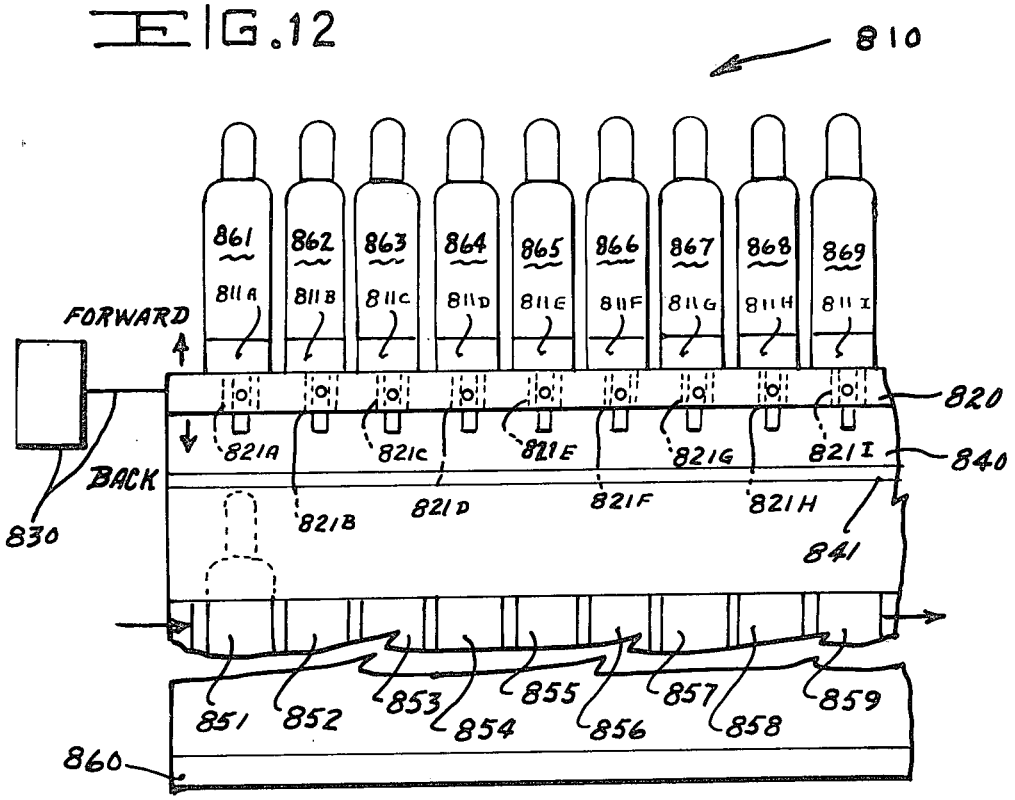
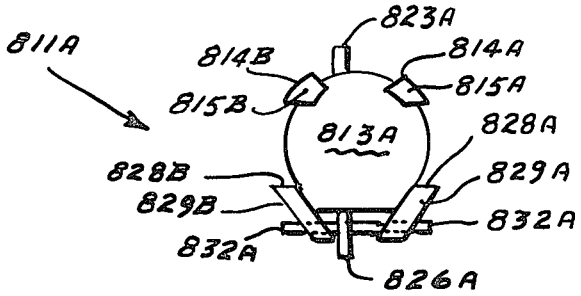
FIG. 14
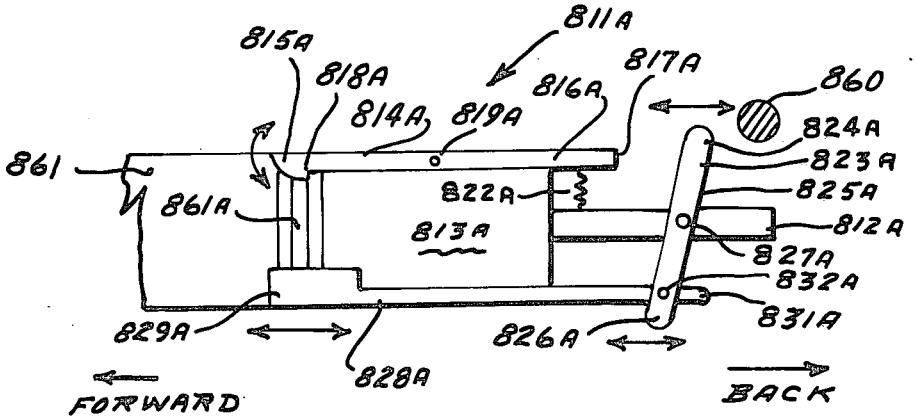
FIG. 13

AUTOMATED AMMUNITION LOADING/DOWNLOADING SYSTEM

STATEMENT OF GOVERNMENT INTEREST

The invention described herein may be manufactured and used by or for the Government for governmental purposes without the payment of any royalty thereon.

CROSS REFERENCE TO RELATED APPLICATION

The inventive system taught herein utilizes, as cooperating components thereof, the inventions taught in three copending patent applications entitled respectively, "Dump Bar Transfer Mechanism", U.S. patent application Ser. No. 697,661, "An Interrupted Intermittent Motion Device", U.S. patent application Ser. No. 697,664, and "Extraction Assembly", U.S. patent application Ser. No. 697,663, all three of which applications have been filed on even date herewith, and all three of which are incorporated herein by reference herein.

ABSTRACT AND SUMMARY OF THE REFERENCED ALLOWED APPLICATIONS

In allowed U.S. patent application Ser. No. 697,644, "Interrupted Intermittent Motion Device", a device is taught that is for use in converting continuous rotary motion input to interrupted intermittent motion output, thereby providing positive movement and precise positioning, as well as a positive locked dwell of drive chains of a vertical conveyor for sequential removal of rows of ammunition from ammunition containers. More specifically, this device permits the indexing of boxes or containers of ammunition past an extraction table, one row at a time, in a cyclic manner; and, it also permits the holding of the boxes in a no-motion dwell position for extraction of the rounds of ammunition in each row, before indexing to the next row. The device comprises a primary driver and a secondary driver that are attached to an input shaft, and a two-sided indexing driven wheel attached to an output shaft. The primary driver engages one of four drive slots on the primary side of the driven wheel, and rotates the driven wheel 72° each time that the input shaft makes one revolution. The secondary driver engages the one slot on the secondary side of the driven wheel 72° every fourth revolution of the input shaft. The indexing driven wheel is locked in a stationary dwell position between indexes by locking rollers on the driven wheel that engage in locking grooves in the primary and secondary driver wheels.

In allowed U.S. patent application Ser. No. 697,663, "Extraction Assembly", an assembly is taught that is adapted to perform sequentially the following: to extract horizontally rounds of ammunition from containers that are being indexed downwardly by a vertical conveyor; to position the extracted rounds of ammunition over a horizontal conveyor; and, to insert these rounds vertically downward into individual round-carrier elements of the horizontal conveyor. The extraction assembly includes a plurality of ammunition round extractor-release mechanisms (i.e., extractors), an extractor bar in which the extractors are mounted side-by-side, an extractor bar drive mechanism operatively connected to the extractor bar, an extractor roller element, and a horizontal extractor table with a dropoff section. The extractor bar operates in a horizontal back-and-forth motion to thrust the extractors forwardly into the ammunition container, and then pull the extractors backwardly together with the rounds of ammunition respectively gripped, held, and extracted by the individual extractors. Each extractor has: two spring-loaded finger elements that grasp the particular round by the extractor grooves on the round, and pull the round out of the ammunition container; and, two sliding finger elements that hold the round of ammunition from the bottom and then slide out of the way to release control of the round and drop it into moving round-carrier elements of the horizontal conveyor.

In allowed U.S. patent application Ser. No. 697,661, "Dump Bar Transfer Mechanism", a mechanism is taught that is for use in rapidly removing rounds of ammunition from conveyor elements, and providing precise placement (by urging, such as by "dumping") of the rounds of ammunition into the next scheduled physical position. More specifically, the mechanism accurately removes rounds of ammunition from a moving horizontal conveyor and places them into a stationary partitioned tray which is disposed below both the mechanism and the conveyor. The mechanism comprises two counter-rotating dump bars driven by an indexing drive assembly which, in turn, comprises a combination of geneva-type indexing drive units and conventional gearing. The indexing drive assembly provides the dump bars with a 16-to-1 dwell-to-drive ratio, and rotates the bars 90° each actuation. The dump bars have guiding surfaces across which the rounds of ammunition are moved by elements of the horizontal conveyor, while the dump bars are in the locked dwell position. When the dump bars are full of rounds, the bars index and transfer the rounds out of the conveyor elements and into the tray for subsequent operations, without interaction with, or interference by, the conveyor. Adjacent rounds that follow the original rounds then begin to fill the bars, and the operation is repeated in a cyclic manner.

BACKGROUND OF THE INVENTION

This invention relates to a system for loading and downloading items and, more particularly, to a system for automatically loading and downloading rounds of ammunition from an aircraft.

With regard to a specific gun system (i.e., the GAU-8/A 30mm) in a particular aircraft (i.e., the A-10), it was desired that an ammunition loading/downloading system attain the following goals: eliminate all linking and the like of rounds of ammunition; eliminate the need for ammunition clips; utilize standard 20mm ammunition containers with 30mm partitions; provide positive round control at all times; eliminate handling of individual rounds by personnel; enable uploading and downloading to be done simultaneously; separate unfired rounds from spent cases; eliminate loading debris; allow in-the-field selectibility of ammunition; provide a rapid interface with the aircraft; require minimum maintenance; exhibit great mobility; be able to be mounted on a standard Air Force ammunition trailer; and, repackage unfired rounds downloaded from the aircraft. However, no such ammunition loading/downloading system existed.

We have invented a unique ammunition system which not only attains the above-mentioned desired goals, but also does so automatically.

Therefore, we have significantly advanced the state-of-the-art.

SUMMARY OF THE INVENTION

This inventive automatic loading/downloading system pertains to a particular preferred embodiment adapted for use in automatically loading/downloading rounds of ammunition (i.e., 30mm caliber) into and from a specific gun system (i.e., the GAU-8/A 30mm) in a particular aircraft (i.e., the A-10).

Accordingly, the principal object of this invention is to teach the structure of such a preferred embodiment of this system.

This principal object, as well as other related objects (such as teaching a novel loader assembly component of the system), of this invention will become readily apparent after a consideration of the description of our invention, coupled with reference to the Figures of the drawings.

DESCRIPTION OF THE DRAWINGS

FIG. 12 is a simplified representation, partially pictorial, partially schematic, and partially fragmented, of a preferred embodiment of the extraction assembly taught in allowed U.S. patent application Ser. No. 697,663;

FIG. 13 is a side elevation view, in simplified form, of the extractor-release mechanism component (i.e., "extractor") of the above-identified extraction assembly, shown during that stage of operation where it has gripped and is holding a representative round of ammunition;

FIG. 14 is an end view, in simplified form, of the extractor-release mechanism component (i.e., "extractor") shown in FIG. 13, without the representative round of ammunition;

DESCRIPTION OF THE PREFERRED EMBODIMENT

Figure 1:
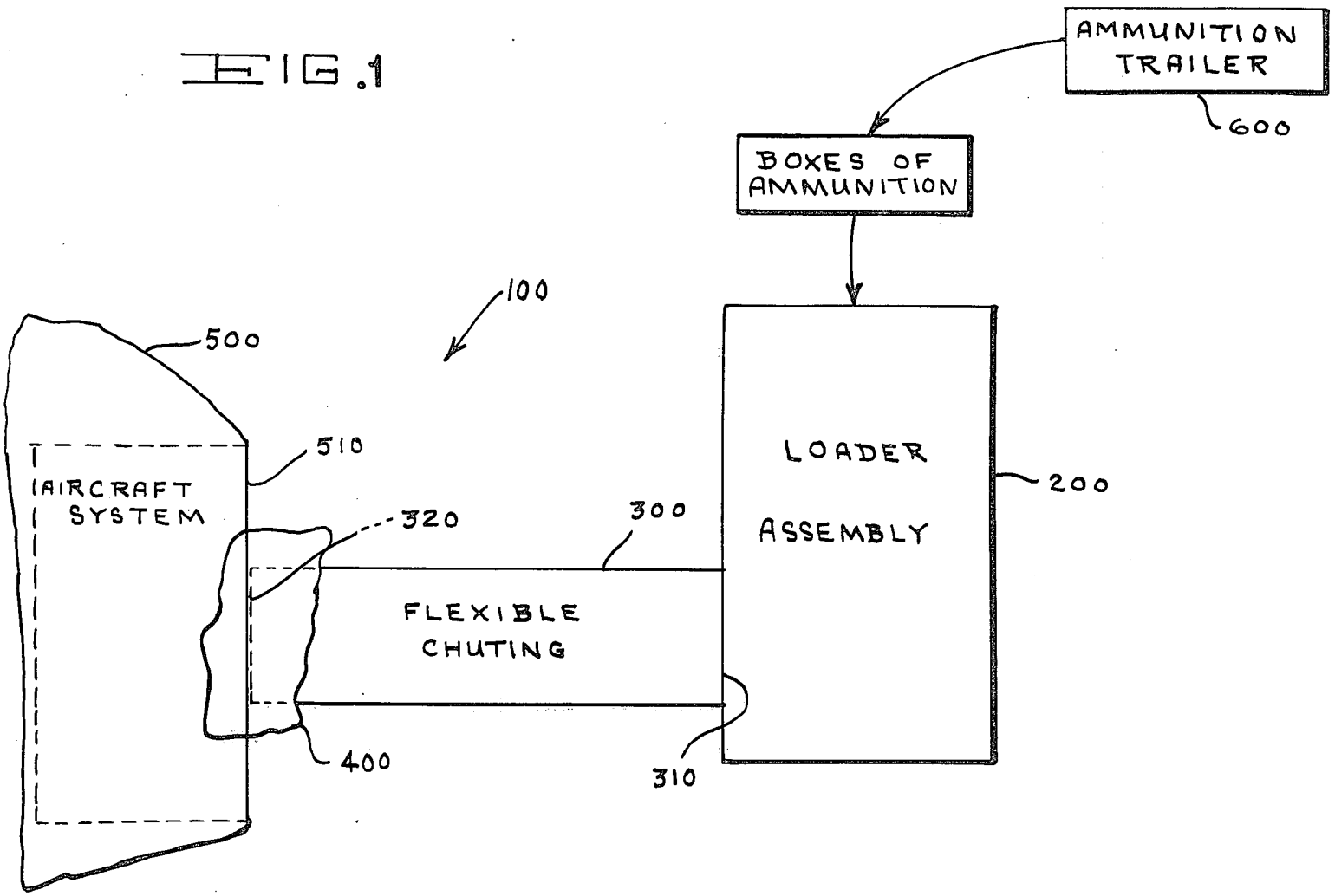
FIG. 1 is a simplified representation, in block diagram form, of the relative positional relationship of a preferred embodiment of the inventive automated loading-/downloading system, as adapted for the particular use of loading and downloading rounds of ammunition onto and from an aircraft.

As a preliminary matter, it is to be noted and to be remembered that our inventive system is an automated system for loading and downloading a plurality of identical items from a plurality of identical containers housing the identical items, with the preferred embodiment 100 herein, FIG. 1, being our system adapted for use in loading and unloading identical rounds of ammunition from identical standardized ammunition containers (or boxes) to an aircraft 500, FIG. 1, that is structured and powered by another system 510 (i.e., the aircraft gun system) to receive and to use live rounds of ammunition (i.e., bullet and cartridge case) and to reject the resultant spent rounds of ammunition (i.e., the empty cartridge cases) and/or the unfired live rounds of ammunition that are already in the other system 510 (i.e., the aircraft gun system).

A preferred embodiment 100 of that adaptation of the inventive system is shown in block diagram form in FIG. 1. Therein one can see: the loader assembly 200 (which includes conveyor elements which are not shown in FIG. 1); means for housing the conveyor elements 300, such as flexible chuting, with the housing means 300 having a first open end, such as 310, and a second open end, such as 320, with the first open end 310 in communication with the loader assembly 200; and, a loader assembly/aircraft interface unit 400 in communication both with the second open end 320 of the housing means 300, and with the aircraft gun system 510 of the aircraft 500 to which and from which the rounds of ammunition are to be loaded and downloaded.

Also shown in FIG. 1 are: an ammunition trailer 600, and standarized containers of live rounds of ammunition, both of which will be discussed later herein.

Figure 2:
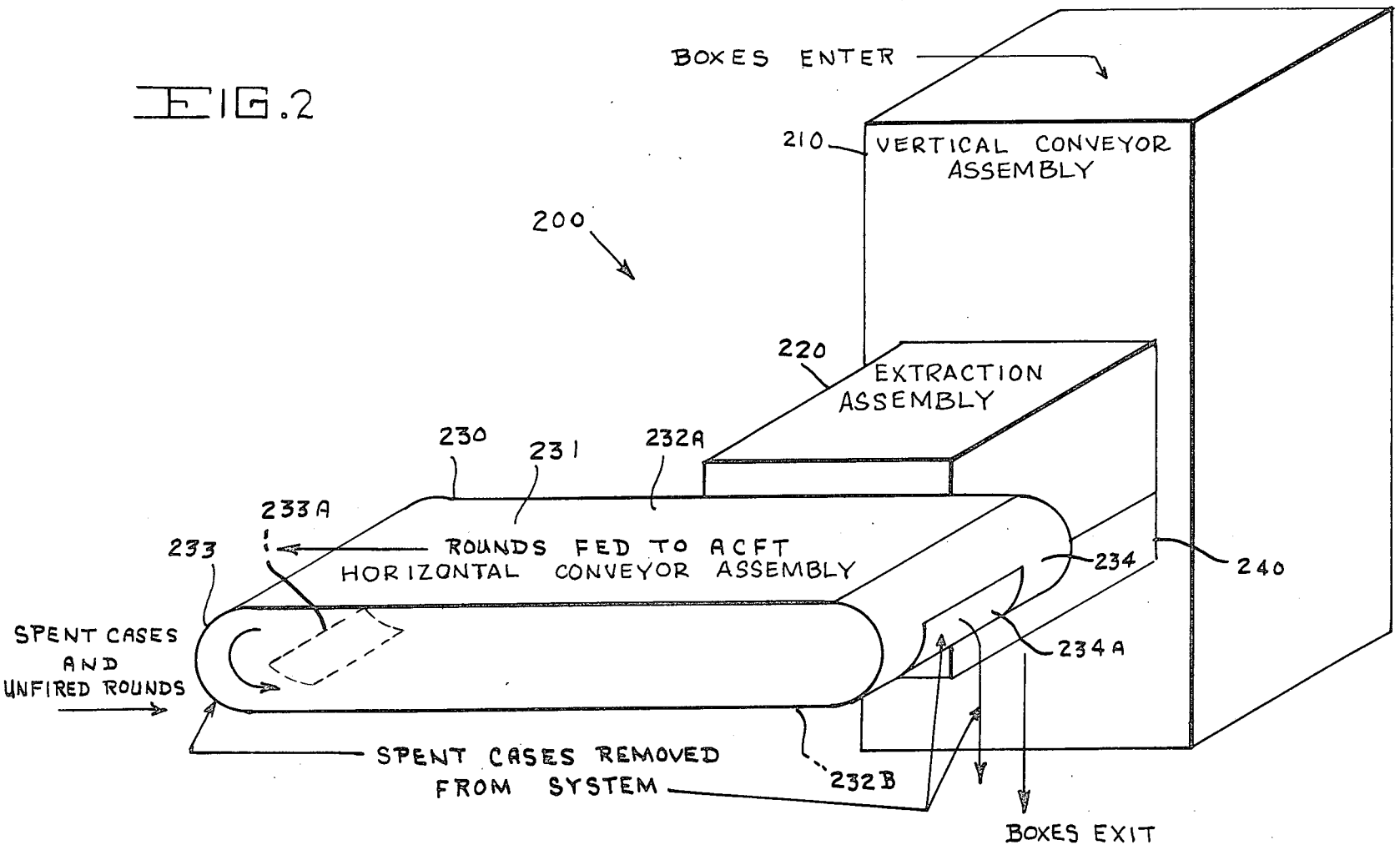
FIG. 2 is also a simplified representation in block diagram and schematic form, of the loader assembly component of the inventive system.

With reference to FIG. 2, therein is shown, in block diagram and simplified schematic form, the loader assembly component 200 of the preferred embodiment 100 of our inventive system. The loader assembly 200 comprises: a vertical conveyor assembly 210 of the type disclosed in copending patent application entitled, "An Interrupted Intermittent Motion Device", filed on even date herewith and herein incorporated by reference; an extraction assembly 220 of the type disclosed in copending patent application entitled, "Extraction Assembly", filed on even date herewith and herein incorporated by reference, with the extraction assembly 220 operatively connected with the vertical conveyor assembly 210; a horizontal conveyor assembly 230 (which will be disclosed and discussed later herein) that is operatively associated with the extraction assembly 220 (and with the aircraft gun system 510, FIG. 1 or, more accurately, with the loader assembly-aircraft interface unit 400, FIG. 1); and, a reloading assembly 240 of the type disclosed in copending application entitled, "Dump Bar Transfer Mechanism", filed on even date herewith and herein incorporated by reference, with the reloading assembly 240 operatively associated with the horizontal conveyor assembly 230.

Figure 3:
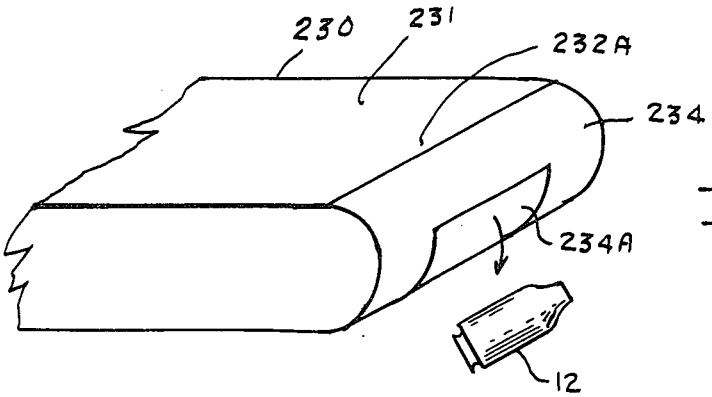
FIGS. 3, 4 and 5 are various views of the horizontal conveyor assembly component (and elements thereof) of the loader assembly.
Figure 4:
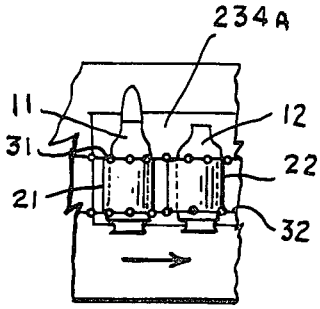
Figure 5:
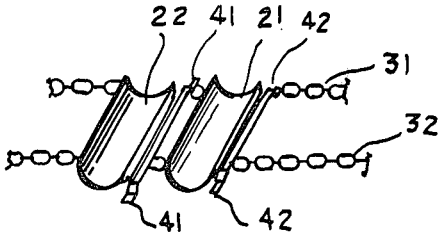

Still with reference to FIG. 2, but simultaneously also with reference to FIGS. 3, 4 and 5, the horizontal conveyor assembly 230 comprises: a housing 231 having a flat table-like upper surface 232A, a lower surface 232B, and two end portions (i.e., first end portion 233 and second end portion 234), with each end portion 233 and 234 having an opening (i.e., opening 233A for 233, and 234A for 234) that is configurated and dimensioned to accept and to permit the passage therethrough of the cartridges of spent rounds of ammunition, such as representative cartridge 12, FIGS. 3 and 4, while not permitting the longer live rounds (that are being returned) from passing through; a plurality of identical individual ammunition round-carrier elements or "buckets", such as representative ones 21 and 22, FIGS. 4 and 5, with these carrier elements or "buckets" connected in an endless chain fashion either to each other or to other common components, such as endless chains 31 and 32, FIGS. 4 and 5, where the bucket-to-chains connection is made by and with mounting and guide tabs 41 and 42, FIG. 5; and, means for moving, in an endless chain manner, (to be shown and discussed later) the individual ammunition round-carrier elements such as 21 and 22, across the flat table-like upper surface 232A, across the end portions 233 and 234, across the end portion openings 233A and 234A, and across the lower surface 232B of the housing 231.

Figure 6:
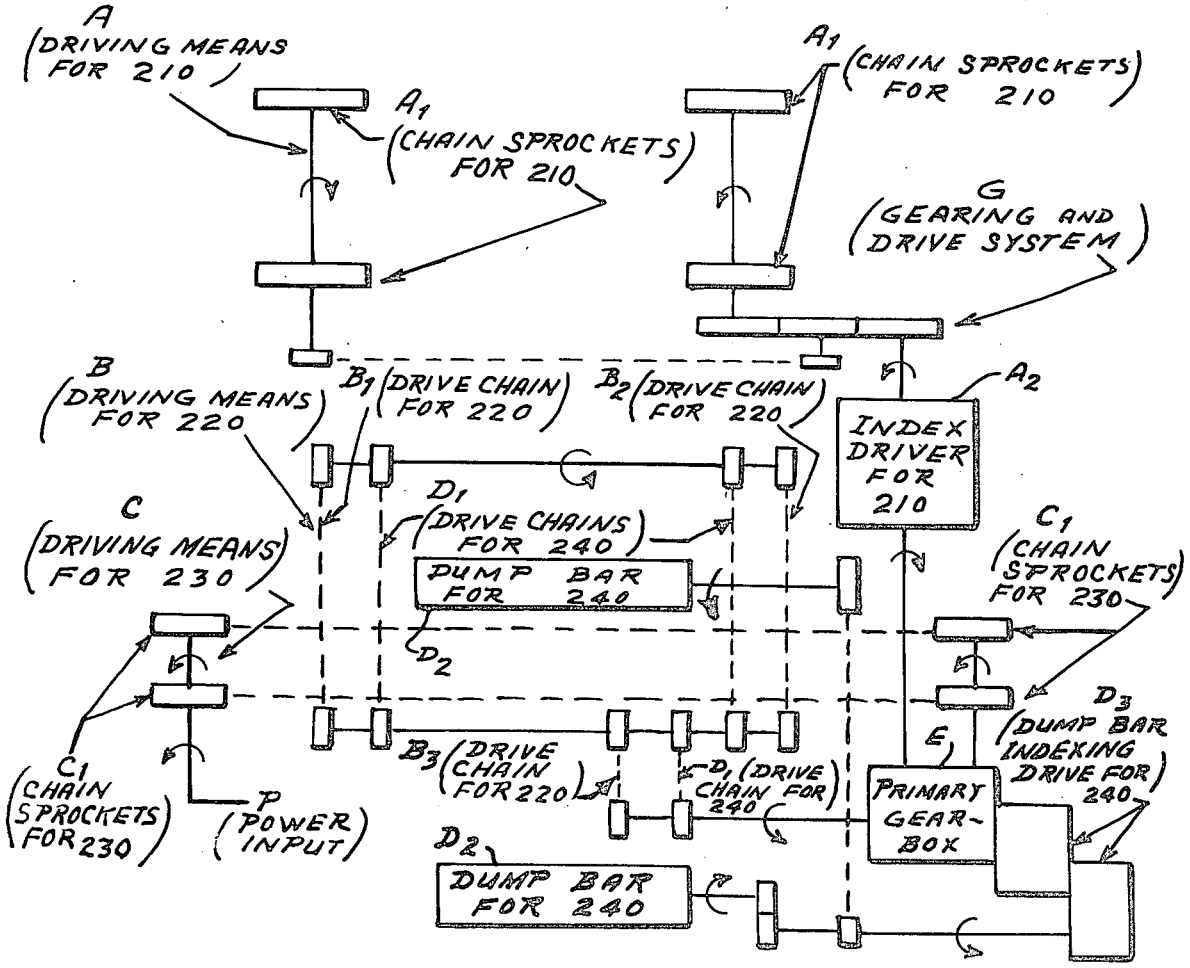
FIG. 6 is a simplified schematic representation of the gearing and chain drives of and for the entire system.
Figure 8:
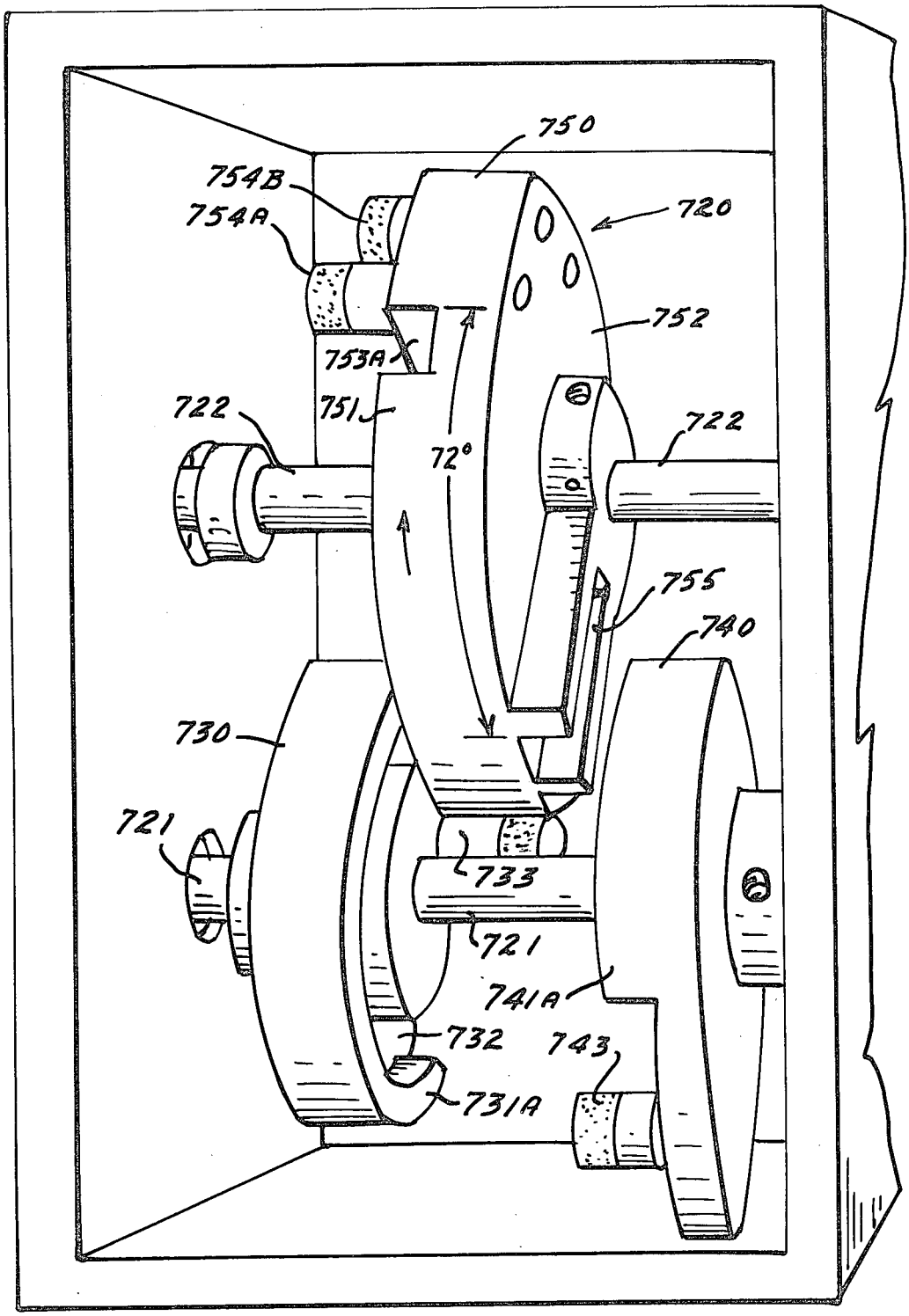
FIGS. 8–11, inclusive, are front views, in simplified pictorial form, of the preferred embodiment of the above-identified interrupted intermittent motion device at different stages of its operation.

With reference to FIG. 6, therein is a simplified schematic representation of the gearing and drive train "G" for the entire automated ammunition loading/downloading system 100, FIG. 1, including of course a representative means for moving, in an endless manner, the individual ammunition round-carrier buckets, such as 21 and 22, FIGS. 4 and 5.

More specifically, and with reference to FIG. 6 in which reference characters (rather than numerals or legends) have been used in the interest of maintaining simplicity of the Figure, to generally designate individual component cooperative gearing and drive chains: the driving means for the vertical conveyor assembly 210, FIG. 2, has been designated "A"; the driving means for the extraction assembly 220, FIG. 2, has been designated "B"; the driving means for the horizontal conveyor assembly 230, FIG. 2, has been designated "C"; and, the driving means for the reloading assembly 240, FIG. 2, has been designated "D". Additionally, the power input to the entire gearing and drive chain system "G" has been designated "P".

The representative means for moving, in an endless manner, the individual ammunition round-carrier elements or buckets, such as 21 and 22, FIGS. 4 and 5, is, of course, the driving means for the horizontal conveyor assembly 230, FIG. 2, which is designated "C" in FIG. 6.

Still more specifically:

With reference to drive "A", FIG. 6, (for the vertical conveyor assembly 210, FIG. 2) said drive includes, but is not limited to, a plurality of vertical conveyor chain sprockets, such as the four designated A1, and an indexing driver for the vertical conveyor, such as the one designated A2;

With reference to drive "B", FIG. 6, (for the extraction assembly 220, FIG. 2), said drive includes, but is not limited to, extractor drive chains, such as B1 and B2, FIG. 6, and extractor drive chain B3, FIG. 6;

With reference to drive "C", FIG. 6, (for the horizontal conveyor assembly 230, FIG. 2), said drive includes, but is not limited to, a plurality of chain sprockets, such as the four designated C1; and, With reference to drive "D", FIG. 6, (for the reloading assembly 240, FIG. 2), said drive includes, but is not limited to, push bar drive chains, such as the three designated D1; dump bars, such as the two designated D2; and, reloading dump bar indexing drive mechanism D3.

It is to be noted that the input drive power is conveyed to the primary gearbox "E" by the horizontal conveyor chains that are operatively connected to, and are disposed between, the two pairs of chain sprockets C1. The primary gearbox "E" then distributes this power to all other components which move or rotate, as indicated by the curved arrows in FIG. 6.

It is also to be noted that the power "P" to the entire gearing and drive chain system "G" may be any suitable power supply or, stated another way, may be any means for producing power, such as by the aircraft gun system 510, FIG. 1. For illustrative purposes, rather than any limitation of the gearing and drive chain system "G", the power means is shown in FIG. 6 as being a hand crank.

DESCRIPTION OF THE PREFERRED EMBODIMENTS TAUGHT IN REFERENCED ALLOWED RELATED APPLICATIONS

As to the Interrupted Intermittent Motion Device

This device is taught in allowed U.S. patent application Ser. No. 697,664.

Figure 7:
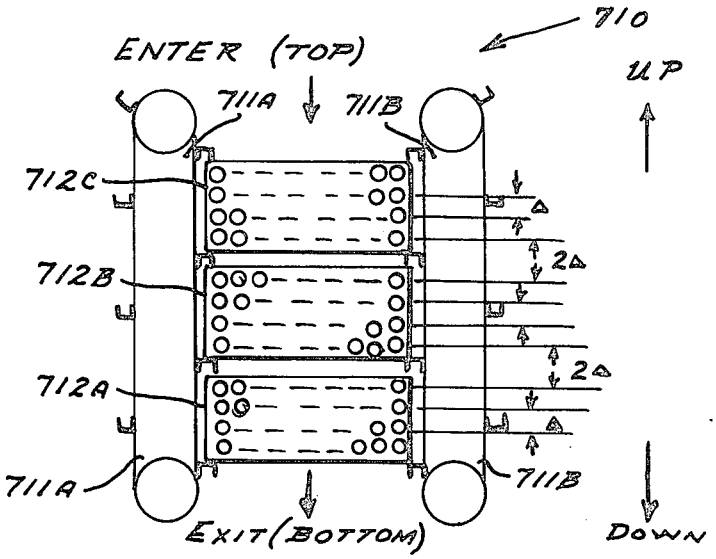
FIG. 7 is a front view, in simpified form, of the environment in which the preferred embodiment of the interrupted intermittent motion device, taught in allowed U.S. patent application Ser. No. 697,664, is used, in cooperation with drive chains of a vertical conveyor.

As a preliminary matter, reference is made to FIG. 7 which shows the contemplated working environment for which the preferred embodiment was adapted.

In FIG. 7, a vertical conveyor, generally designated 710, is shown filled with plurality of partitioned ammunition shipping/storage boxes or containers, such as 712A, 712B and 712C, which are moved by drive chains 711A and 711B. The containers, which are filled with rounds of ammunition, enter at the top and exit at the bottom, as indicated by the legends and arrows; and, to better orient the reader with the directional designations "Up" and "Down", together with their respective arrows, are also shown.

In conjunction with the operation of our invention, "Automated Ammunition Loading/Downloading System", which is taught herein, it was desired to drive the vertical conveyor assembly 710 in a preselected precise, interrupted and intermittent cyclic manner.

More specifically, it was necessary to index a plurality of ammunition containers, such as 712A, 712B and 712C, past an extraction table (not shown, but perpendicular to the drawing) at the rate of one row of rounds of ammunition at a time in a cyclic manner; and, to hold the containers in no-motion dwell position for extraction of the rounds in each row, before indexing to the next row. The spacing between adjoining rows in each box is a constant distance $\Delta$. The distance between the top row of a container and the bottom row of the container above that container is $2\Delta$, as shown in FIG. 7. This required that the cyclic indexing sequence move the containers the distance listed below:

| Row Index | Distance Moved |
|---|---|
| Bottom row to 2nd row | Δ |
| 2nd row to 3rd | Δ |
| 3rd row to top row | Δ |
| Top row to bottom row of container above | 2 Δ |

This sequence would then be repeated.

The interrupted intermittent motion device taught herein is intended to be mechanically geared to the conveyor sprockets to turn them the above-described incremental rotations.

With reference to FIGS. 8–11, inclusive, wherein the same reference numeral or character denotes the same element or the like, one can see that, in the most generic sense, the preferred embodiment 720 of my inventive interrupted intermittent motion device comprises: a rotatable input drive shaft 721; a primary driver wheel 730 disposed on or otherwise attached to the input drive shaft 721; a secondary drive wheel 740 also disposed on or otherwise attached to the input drive shaft 721; and, a two-sided indexing driven wheel 750 disposed on or otherwise attached to a rotatable output shaft 722.

The primary driver wheel 730 has an internal surface 731A, a locking groove 732 in the internal surface 731A, and a driver roller 733 connected to and protruding from the internal surface 731A.

The secondary driver wheel 740 has an internal surface 741A facing the internal surface 731A of the primary driver wheel 720, a locking groove 742 in the internal surface 741A, and a driver roller 743 connected to and protruding from the internal surface 741A.

The two-sided indexing driven wheel 750 has a first side surface 751 that is facing the internal surface 731A of the primary driver wheel 730, and a second side surface 752 that is facing the internal surface 741A of the secondary driver wheel 740.

The first side surface 751 of the driven wheel 750 has a plurality of drive slots therein, preferably four of them, such as 753A, 753B, 753C and 753D; and, said surface 751 also has connected thereto and protruding therefrom a plurality of locking rollers, preferably six of them, such as 754A, 754B, 754C, 754D, 754E and 754F.

The second side surface 752 of the driven wheel 750 has one drive slot 755 therein, and also has a plurality of locking rollers, preferably two of the, such as 756A and 756B, connected to and protruding from the second side surface 752.

Figure 9:
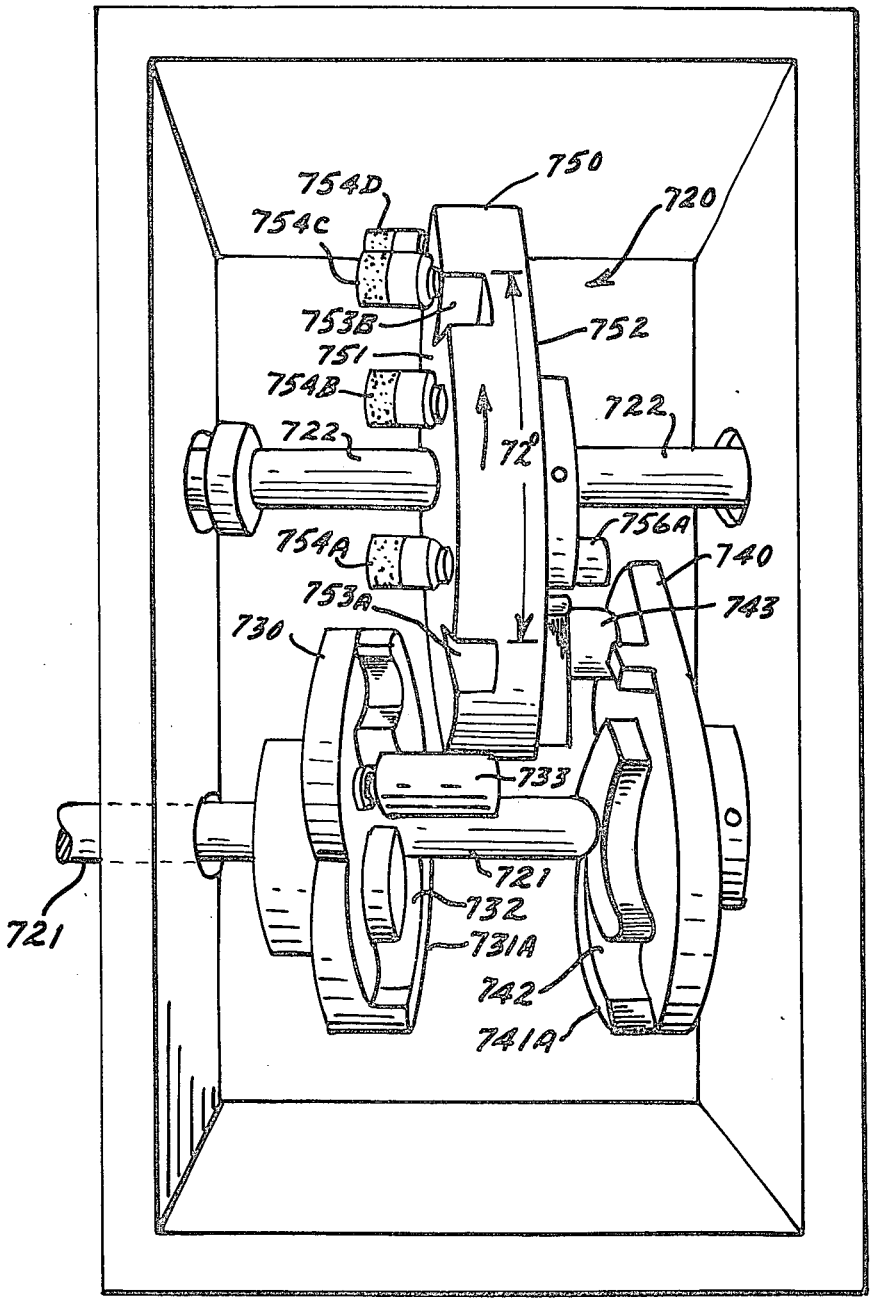
Figure 10:
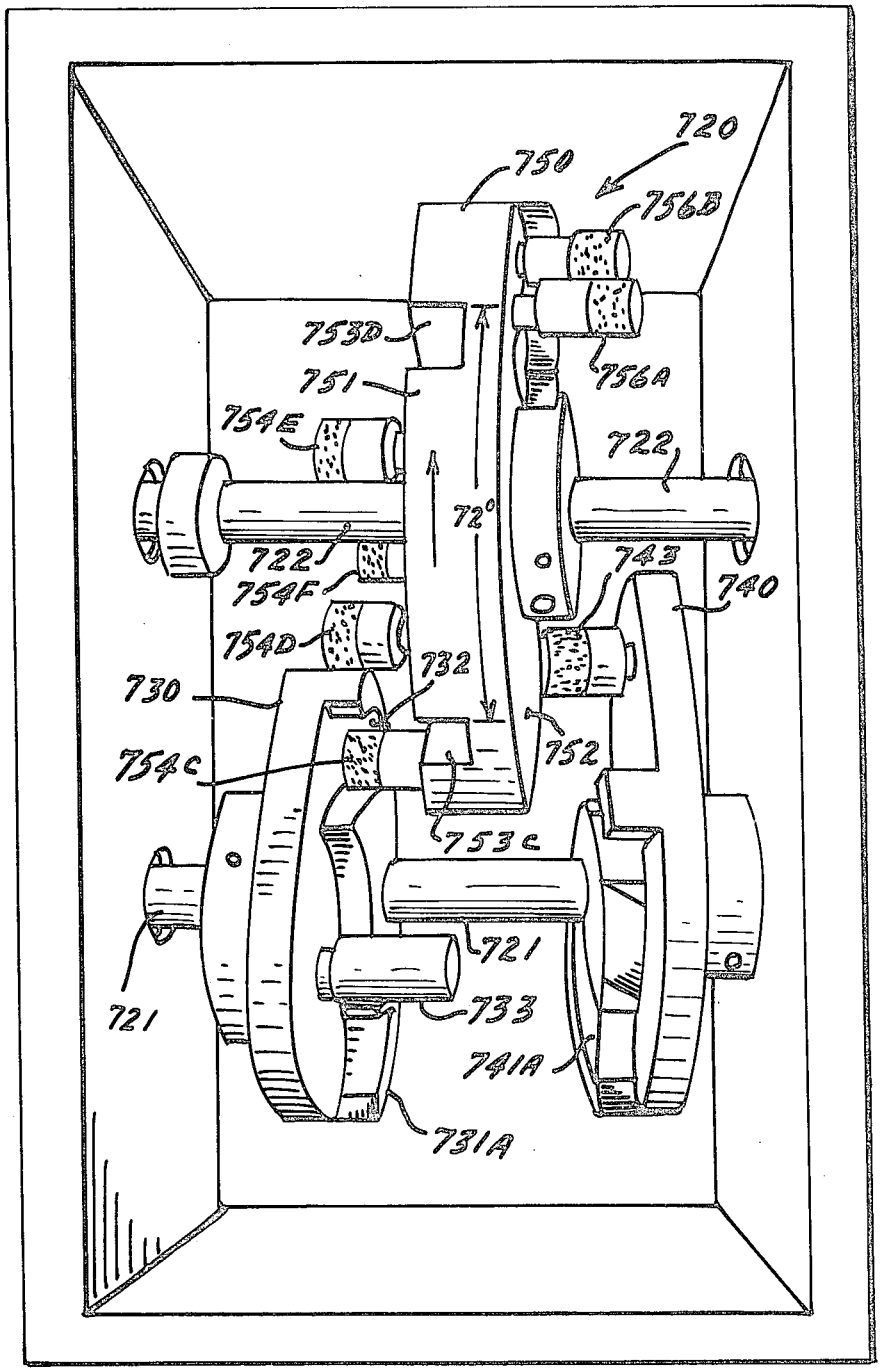
Figure 11:
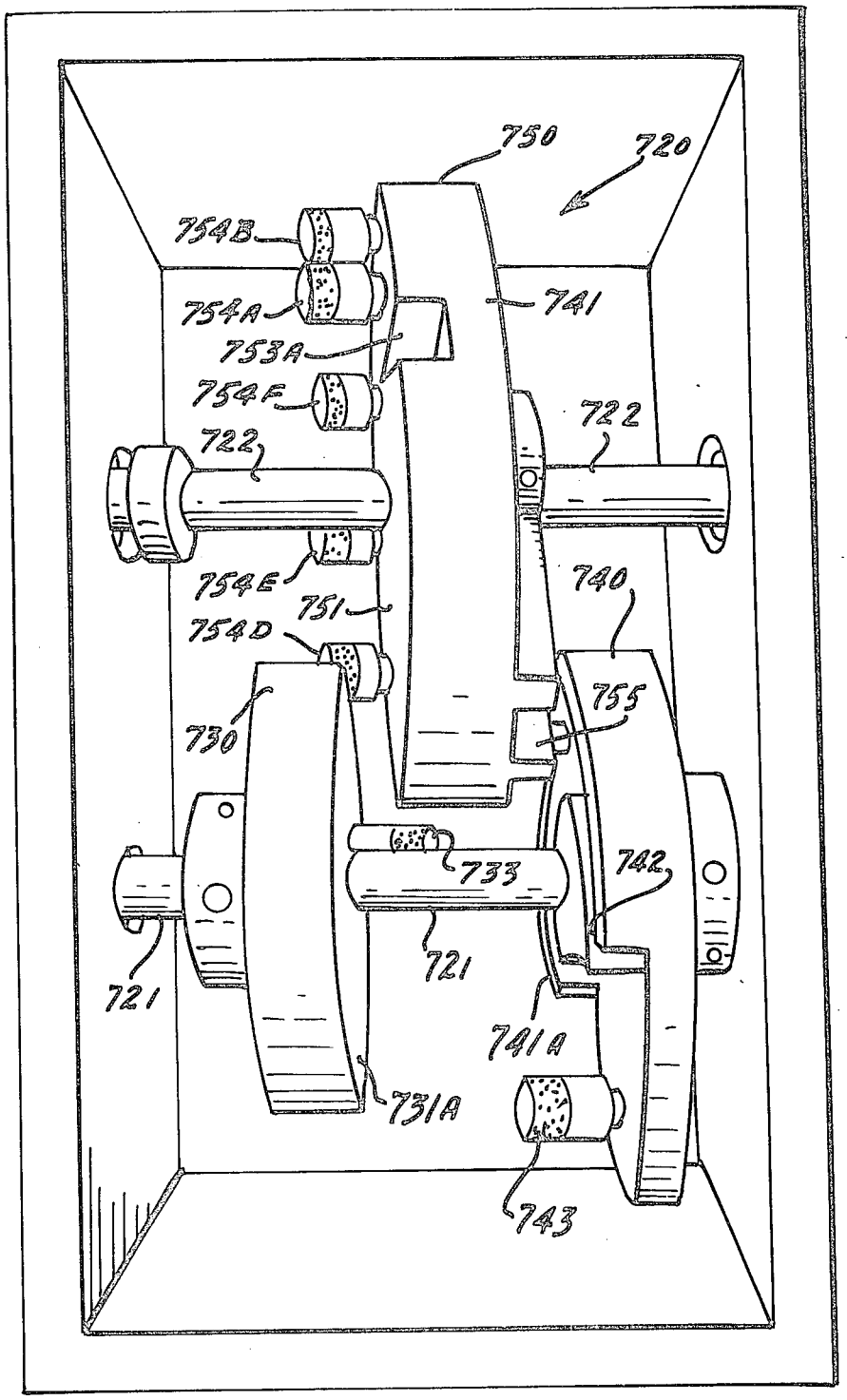

It is to be noted that each drive slot of the driven wheel 750 (i.e., 753A, 753B, 753D and 755) is 72° apart from each of the two adjacent drive slots (for example: drive slot 753C, FIG. 10, is 72° away from drive slot 753D, FIG. 10, and also 72° away from drive slot 753B, FIG. 9).

It is also to be noted that each drive slot (i.e., 753A, 753B and 753C) on the first side surface 751 of drive wheel 750 is dimensioned and configurated, individually and separately, to accept, engage with, and releasably hold the driver roller 733 of the primary driver wheel 730; and, that the drive slot 755 on the second side surface 752 of the driven wheel 750 is dimensioned and configurated to accept, engage with, and releasably hold the driver roller 743 of the secondary driver wheel 740.

It is further to be noted that the motion of the driven wheel 750 in FIGS. 8–11, inclusive, is as indicated by the directional arrow thereon.

As to the Extraction Assembly

This assembly is taught in allowed U.S. Patent application Ser. No. 697,663.

With reference to FIG. 12, therein is shown a preferred embodiment 810 of our invention. In it's most simple and generic form, the preferred embodiment comprises: a plurality of extractor-release mechanisms (hereinafter referred to as "extractors"), preferably nine (9) for the function intended, such as representative ones 811A–811I, inclusive; a movable extractor bar 820 (which has a plurality of openings therethrough, preferably nine 821A–821I, inclusive) to which each of the said plurality of extractors, such as 811A–811I, are mounted in a side-by-side relationship; means 830 for moving (or otherwise driving) the extractor bar 820; an extractor roller 860, to the rear of and above, the extractor bar 820; and, an extractor-release table 840 disposed below the plurality of extractors, with the table 840 having a "drop-off" section 841, Also shown in FIG. 12 are nine representative rounds of ammunition 861–869 being held individually by separate and distinct extractors (e.g., round 861 by extractor 811A, round 862 by extractor 811B, and so forth) after having been extracted from a standard ammunition container (i.e., box, not shown).

Still with reference to FIG. 12, also shown therein are individual single-round carrier elements, such as representative ones 851–859, inclusive, of a horizontal conveyor 850. The carrier elements are disposed below, and aft of, the original position of the rounds of ammunition (and, of course, the "drop off" portion 841 of the stationary table 840); and, the conveyor round-carrier elements are movable.

With reference to FIG. 13, therein is shown a representative extractor 811A of the plurality of extractors 811A–811I, shown in FIG. 12. The extractor 811A is enlarged and not to scale, in order to better show the elements thereof. As can be easily seen, the extractor 811A, as well as the other extractors of the plurality, comprise: a support shaft 812A; a body 813A that is essentially cylindrical in shape and is attached to the support shaft 812A; a plurality of movable finger-like grasping elements, such as representative one 814A, having a first end 815A, a middle portion 816A, and a second end 817A, with the first end 815A having a hook-like projection 818A, the middle portion 816A pivotally connected by suitable means, such as pin 819A, to the cylindrical body 813A, and the second end 817A biased by suitable means, such as spring 822A, to the support shaft 812A; an actuation lever 823A, having a first end 824A, a middle portion 825A, and a second end 826A, with the middle portion 825A pivotally connected by suitable means, such as pin 827A, to the support shaft 812A; and, at least one (and, preferably, two) finger-like slide elements, such as representative one 828A, having a first end 829A and a second end 831A, with the second end 831A pivotally connected to the first end 826A of the actuation lever 823A by suitable means, such as pin 832A, and with the finger-like slide element 828A abutting with and slidably movable along the cylindrical body 813A, as indicated by the two-headed arrow.

Also shown in FIG. 13 is representative round of ammunition 861 which, like the other representative rounds, has extractor grooves 861 where the finger-like grasping elements, such as 814A, grip and releasably hold the individual round, such as 861, by the hook-like projection 818A of the finger-like element 814A.

Still with reference to FIG. 13, and more particularly with regard to grasping element 814A, said element is movable upwardly or downwardly, as clearly ascertainable from its structural linkage with spring 822A, support shaft 812A, and actuation lever 823A and with body 813A via pivot 819A, and as shown by the two-headed arc-like arrow near first end 815A.

Also shown in FIG. 13 is a cross section of extractor roller 860, previously shown length-wise in FIG. 12. As can be seen, the extractor roller 860 is positioned at a height at which the actuation lever, such as representative one 823A, will strike the extractor roller 860.

Now, with reference to FIG. 14, which is a simplified end view of representative extractor 811A, but without representative round 861 being held therewith, the positional relationships of body 813A, grasping elements 814A and 814B with their respective hook-like projections 815A and 815B, sliding elements 828A and 828B and their respective first ends 829A and 829B, and actuation lever 823A with pin 832A, can be very easily seen.

As to the Dump Bar Transfer Mechanism

This mechanism is taught in allowed U.S. patent application Ser. No. 697,661.

Figure 15:
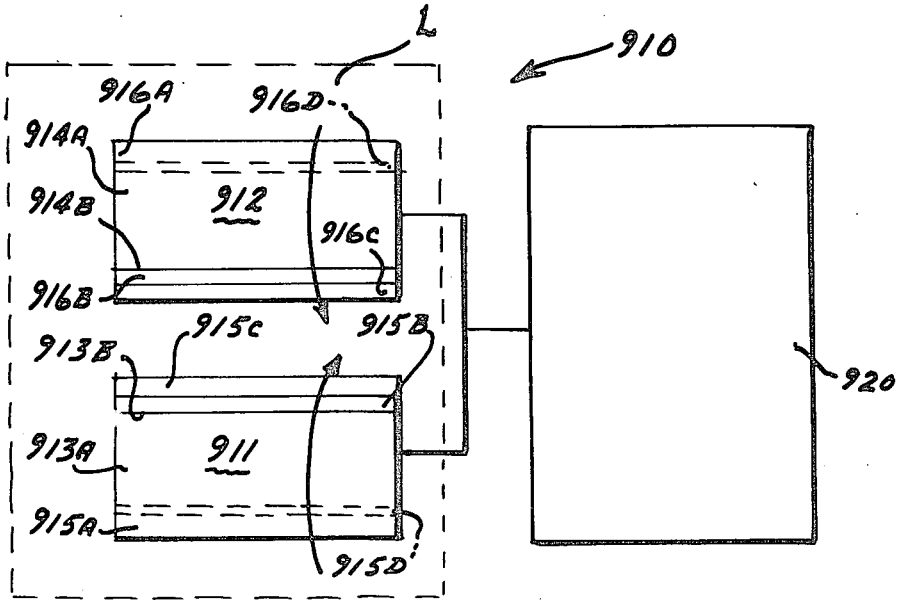
FIG. 15 is a simplified, block diagram representation of the dump bar transfer mechanism, in its most generic structural form, that is taught in allowed U.S. patent application Ser. No. 697,661.

With reference to FIG. 15, therein is shown a simplified, block-diagram representation of the generic form of a preferred embodiment 910 of the invention.

In its most basic structural form, the embodiment 910, comprises: a plurality of rotatable dump bars, such as first dump bar 911 and second dump bar 912 in parallel spaced apart relationship to each other, with each dump bar having a plurality of intersecting planar surfaces, such as 913A and 913B of first dump bar 911, and 914A and 914B of second dump bar 912, with each surface having an extension (or ammunition guiding surface), such as 915A, 915B, 915C and 915D for first dump bar 911, and 916A, 916B, 916C and 916D for second dump bar 912; and, means 920 for selectively rotating each rotatable dump bar, such as 911 and 912, with the rotating means 920 operatively associated with each dump bar by suitable conventional means.

As shown by the curved directional arrows in FIG. 15, the dump bars 911 and 912 are counter-rotatable.

Figure 16:
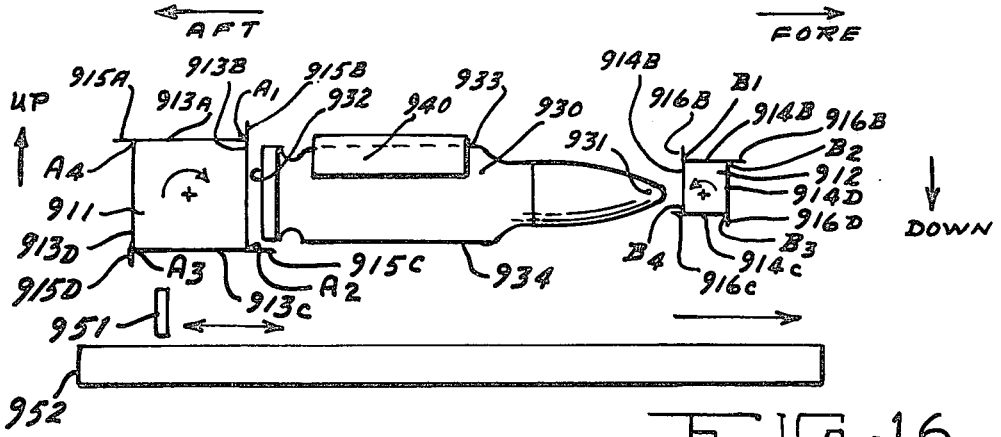
FIG. 16 is a side elevation view, in simplified form, partially pictorial and partially schematic, of some major elements of the above-identified dump bar transfer mechanism in their working environment.

Now, with reference to FIG. 16, the plurality of intersecting planar surfaces of first dump bar 911 (i.e., 913A, 913B, 913C and 913D) and of second dump bar 912 (i.e., 914A, 914B, 914C and 914D) can be easily seen. The surface extensions of first dump bar 911 (i.e., 915A, 915B, 915C and 915D) and of second dump bar 912 (i.e., 916A, 916B, 916C and 916D) are also easily seen.

First and second dump bars 911 and 912 are essentially in the same plane, such as "L", FIG. 15, and, as a matter of preference rather than of limitation, the plane "L" is horizontal. Also as a matter of preference, the first and second dump bars 911 and 912 each have four intersecting planar surfaces forming four intersections with a dihedral angle of 90° at each intersection (i.e., angles M1, M2, M3 and M4 as to first dump bar 911; and angles N1, N2, N3 and N4 as to second dump bar 912), as shown in FIG. 16. The vertical cross section of each dump bar, as shown in FIG. 16, is preferably a square.

Also shown in FIG. 16 are: a representative round of ammunition 930 being transferred by a moving horizontal conveyor (not shown), a conveyor element 940 which is releasably holding the ammunition round 930; a push bar 951 positioned below dump bars 911 and 912 and ammunition round 930, with the push bar 951 being horizontally transversely movable fore and aft, as indicated by the double-headed arrow; and a stationary tray 952 that is partitioned transversely and that is horizontally-positioned below the push bar 941 and, of course, below the dump bars 911 and 012 and below the round 930 to be transferred.

The round of ammunition 930, FIG. 16, has a fore end 931, an aft end 932, an upwardly facing external surface portion 933, and a downwardly facing external surface portion 934.

Further, the horizontally-moving conveyor (of which ammunition round holder or carrier 940 is an element) and the horizontally-positioned stationary tray 952 are, as a matter of preference, in equal spaced-apart relationship.

Still with reference to FIG. 16, the first dump bar 911 is disposed aft of the aft end 932 of representative ammunition round 930, while the second dump bar 912 is disposed fore of the fore end 931 of the round 930. The extension or guiding surface (such as 915C) of one of the intersecting planar surfaces (such as 913C) of the first dump bar 911 abuts the downwardly facing external portion 934 of the aft end 932 of representative round 930; and, the extension or guiding surface (such as 916C) of one of the intersecting planar surfaces (such as 914C) of the second dump bar 912 abuts the downwardly facing portion 934 of the fore end 931 of round 930.

Figure 17:
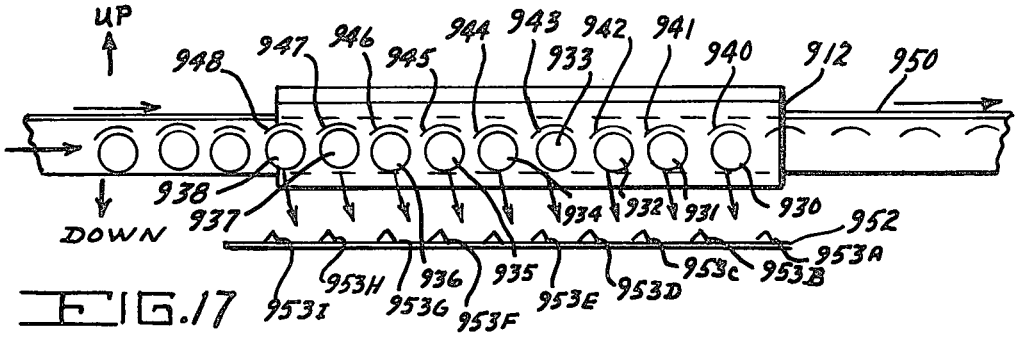
FIG. 17 is a front view, in simplified form, also partially pictorial and partially schematic, of the same major elements and working environment that were shown in FIG. 16.

Now, with reference to FIG. 17, which is a front view of the components shown in FIG. 16, less the first dump bar 911, FIGS. 15 and 16, and the push bar 951, FIG. 16, so that the positional relationship of the rounds of ammunition and other items may be better seen. Easily seen are second (fore) dump bar 912, moving horizontal conveyor 950, a plurality of conveyor elements (such as representative ones 940–948, inclusive) that are connected to the horizontal conveyor 950, stationary tray 952 with partitions (such as representative ones 953A–953I, inclusive) that are transverse to the movement of the horizontal conveyor 950, and parallel to and below the rounds of ammunition.

Figure 18:
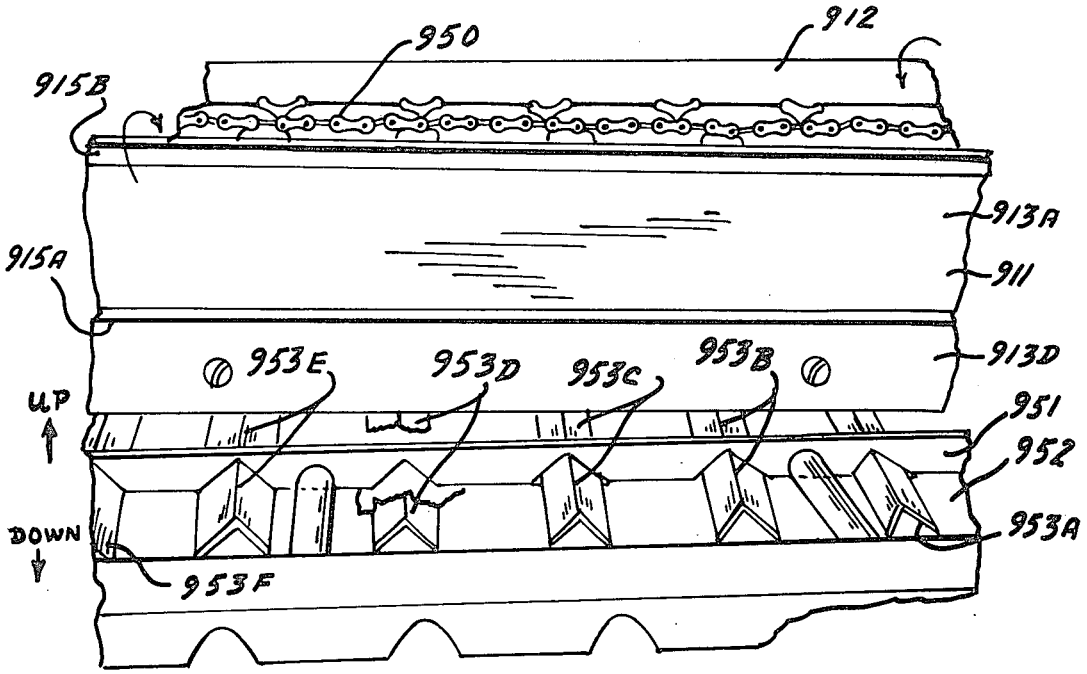
FIG. 18 is a pictorial representation of the front view of some of the major elements of the above-identified dump bar transfer mechanism in the working environment.

With reference to FIG. 18, therein is a close-up pictorial representation of the components shown in FIGS. 16 and 17, including the first dump bar 911, but less the rounds of ammunition. Easily seen, in their relative positional relationship, are: second dump bar 912, with a rotational arrow to designate its direction of rotation; moving horizontal conveyor 950; first dump bar 911, likewise with a rotational arrow, and with representative intersecting planar surface 913A and 913D, representative planar surface extensions (or "guide surfaces") 915B and 915A; stationary horizontal tray 952 with representative transverse partitions 953A–953F, inclusive; and, push bar 951.

Figure 19:
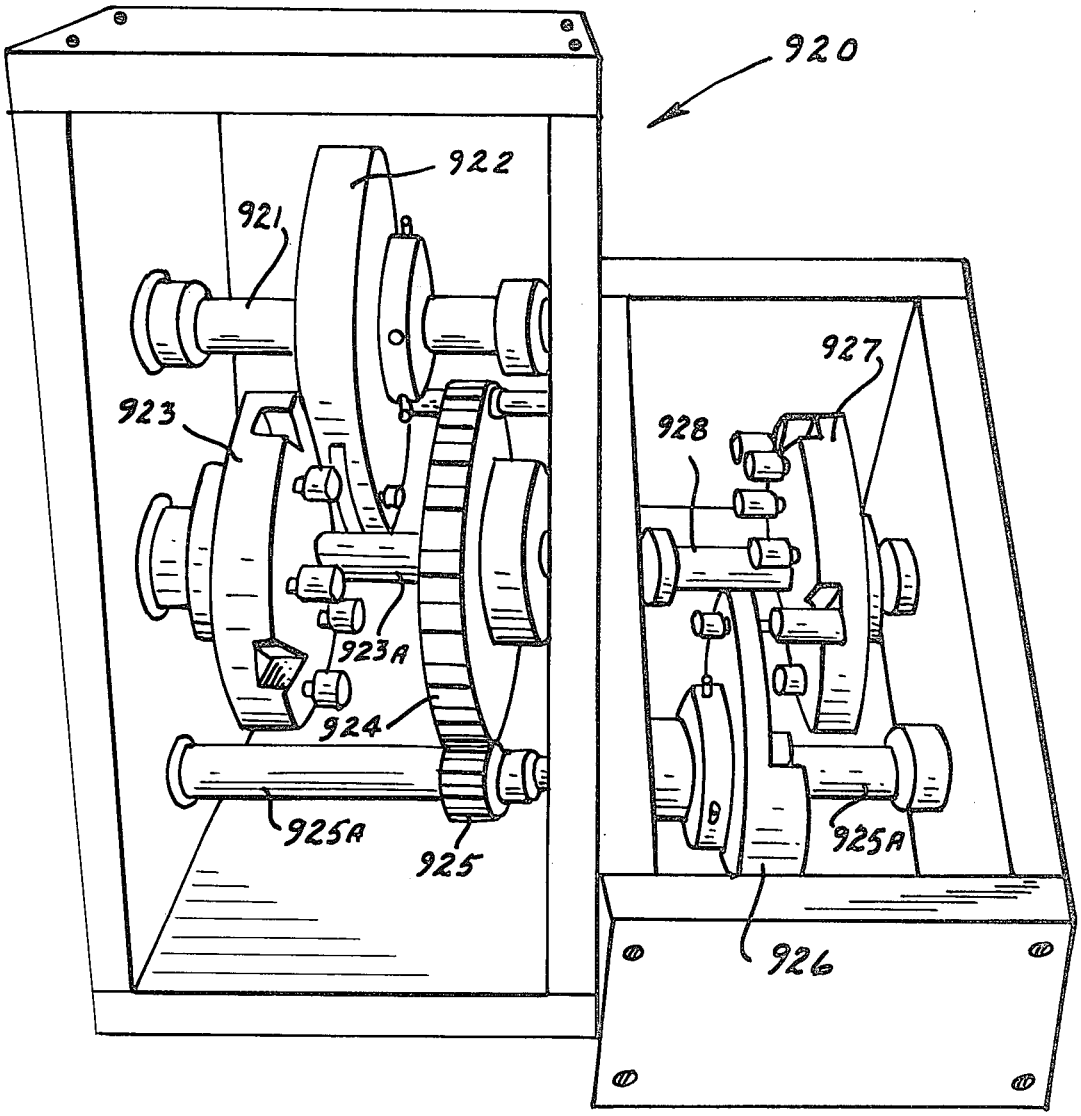
FIG. 19 is a pictorial representation of the other major elements of the above-identified dump bar transfer mechanism.

In FIG. 19, as shown, principally in pictorial form, the preferred components which collectively comprise the means 920, FIG. 15, for selectively rotating each rotatable dump bar, such as 911 and 912, FIGS. 15–18, inclusive. In essence, the means 920 comprises a series of co-acting geneva-type drive mechanisms with associated spur gears to provide a preferred 16-to-1 dwell-to-drive ratio for the output shaft 928.

Means 920 (hereinafter referred to as the "indexing drive assembly") preferably comprises: a rotatable input drive shaft 921; a primary driver element 922 disposed on the input drive shaft 921; a primary driven wheel 923 disposed on a rotatable first drive shaft 923A and driven by the primary driver element 922; a first tooth spur gear 924, having a preselected number of gear teeth (preferably 60 gear teeth), disposed on the first drive shaft 923A; a second tooth spur gear 925 disposed on a rotatable second shaft 925A and engaged with the first tooth spur gear 923, with the second gear 25 having a preselected number of gear teeth that are less in number than the preselected number of gear teeth of the first tooth spur gear (e.g., if the first gear 23 has 60 teeth, then it is preferred that the second gear 25 have 15 teeth); a secondary driver element 926 disposed on the rotatable second shaft 925A; a secondary driven wheel 927 driven by the secondary driver element 926; and, a rotatable output shaft 28 on which is disposed the secondary driven wheel 927.

Figure 20:
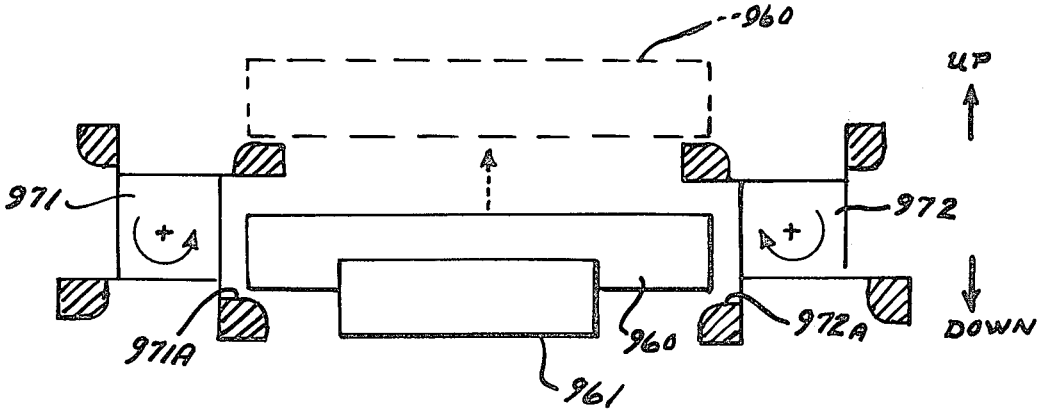
FIG. 20 is a side elevation view in simplified schematic form, of a variation of the above-identified dump bar transfer mechanism.

With reference to FIG. 20: The length and the shape of the dump bars and the dwell-to-drive ratios of the indexing-type drive unit can be arranged to accommodate a wide range of items with varying shapes in varying quantities for each cycle. As can be seen by examination of FIG. 20, the basic structural concept can be applied to transfer, or otherwise to move, an item (such as a cylinder) vertically upward. More specifically, and with continued reference to FIG. 20, the cylinder 960, removably held in conveyor element 961, is transferred vertically upward by guiding surfaces (or surface extensions), such as 971A of dump bar 917, and 972A of dump bar 972, as the dump bars 971 and 972 are rotated toward each other (i.e., counter-rotated) by suitable means, such as an indexing drive assembly similar to the one disclosed herein.

MANNER OF OPERATION OF THE PREFERRED EMBODIMENT

The manner of operation of the preferred embodiment 100 of our automated ammunition loading/downloading system 100, FIG. 1, and of the principal component thereof, i.e., the loader assembly, 200, FIGS. 1 and 2, can easily be ascertained by any person of ordinary skill in the art from the foregoing description, coupled with reference to the Figures of the drawing herein, and further coupled with reference to the three other copending patent applications related to this inventive system, namely: "Dump Bar Mechanism", "An Interrupted Intermittent Motion Device", and "Extraction Assembly", all three of which have been filed on even date herewith, and all three of which have been incorporated by reference herein.

For others, the following is an explanation:

The three components of our system 100 (i.e., the loader assembly 200, the flexible chuting 300, and the loader assembly/aircraft interface unit 400), although separate, form an integrated mobile system. This system can be, and is, taken to the aircraft, such as 500, FIG. 1, for loading and downloading, and the interface unit 400 is attached to the aircraft 500 and provides a mechanical interface between the loader assembly 200 and the aircraft gun system 510. The ammunition is brought to the loading site by suitable means, such as by being carried on a standard ammunition trailer, such as 600, FIG. 1. In that regard, it is to be noted that the loader assembly 200, the flexible chuting 300, and the interface unit 400 could be mounted to the ammunition trailer, if desired.

An operator of one of our systems will only be required to attach the loader/aircraft interface unit 400, FIG. 1, to the aircraft gun system 510 and then load the full boxes of ammunition (see FIG. 1) into the vertical conveyor 210, FIG. 2, of the loader assembly, and remove the boxes when they exit from the vertical conveyor (see FIG. 2). All else is done automatically by the loader assembly 200, FIGS. 1 and 2.

It is to be noted that the loader assembly 200, FIGS. 1 and 2, is driven by the aircraft gun system 510, FIG. 1, though the loader/aircraft interface unit 400, FIG. 1, and the flexible chuting 300, FIG. 1.

Our automated loading/downloading system is able to perform any of the following operations automatically:

A. Simultaneously load and download the aircraft gun system (i.e., operate the loader in the forward direction and place the full boxes of the rounds of ammunition into the vertical conveyor 210, thereby emptying the boxes or containers of the live rounds and then refilling the boxes or containers with the downloaded rounds already in the aircraft gun system and being returned).

B. Only download the aircraft gun system (i.e., operate the horizontal conveyor 230, FIG. 2, in either direction and place the empty ammunition boxes or containers into the vertical conveyor 210, FIG. 2, to be filled with the downloaded ammunition already in the aircraft gun system and being returned from the gun system).

C. Only load the aircraft gun system (i.e., operate the horizontal conveyor in the forward direction and place the full boxes into the vertical conveyor to be emptied).

It is to be noted that the vertical conveyor 210, FIG. 2, will always operate in the downward direction only.

As an example of the specific manner of operation of the preferred embodiment of our inventive system, the following is a detailed step-by-step description of the simultaneous loading and downloading of the aircraft gun system (and the separating of the spent cartridge cases from the unfired rounds already in the aircraft gun system, but being downloaded, i.e., returned).

Firstly, the operator attaches the loader assembly 200 to the aircraft gun system 510 (which already has spent cartridge cases and unfired live rounds of ammuniton in it) by means of the interface unit 400 and the chuting 300.

Then, the operator places full boxes (with their covers removed) of rounds of ammunition horizontally into the vertical conveyor 210.

Next, the vertical conveyor 210 indexes the loaded boxes downward past the extractor table, where the rounds are removed horizontally from their respective ammunition boxes at the rate of one row of rounds at a time.

Then, the rounds are placed into elements or buckets of the moving horizontal conveyor 230 and are transferred to the aircraft gun system 510.

Next, while "new" unfired rounds of ammunition are being loaded into the aircraft gun system 510 by the horizontal conveyor, spent cases and unfired live rounds from the aircraft gun system are returned by, and separated by, the horizontal conveyor.

Then, with particular reference to FIG. 4, the spent cartridge cases, such as representative one 12, are separated from the unfired rounds, such as representative round 11, in and by the horizontal conveyor because the unsupported spent cartridge cases 11 will fall through opening 234A, while the unfired round 12 will not fall through, because of its longer length. Next, the unfired returned rounds continue to the reloader table, where they are removed from the individual carrier elements or buckets, and are pushed into the ammunition boxes that have just been unloaded.

Lastly, the ammunition boxes drop from the bottom of the vertical conveyor 210 and are ready to be returned to an ammunition storage area. It is to be noted that these boxes at this step in the sequence will either be empty or will contain unfired returned live rounds of ammunition.

In summary, therefore, what occurs is that full ammunition boxes are loaded into the top of the vertical conveyor 210 and are indexed vertically downward past the extraction assembly 220, where the rounds of ammunition are pulled horizontally out of their respective ammunition boxes and over individual round carrier elements or buckets. The rounds are then dropped vertically downward out of the extractors and into the individual carrier elements (of the horizontal conveyor 230) that transfers them to the aircraft gun system 510. Spent and unfired rounds are returned from the aircraft gun system 510 in the returning conveyor elements, and spent cases are separated from the unfired returned rounds, with the unfired rounds being conveyed to the reloading assembly 240 where they are removed vertically downward (see FIGS. 2 and 3) from the conveyor elements by the reloading dump bars and reloaded into the empty ammunition boxes in the vertical conveyor 210, by being pushed by a reloading push bar. The empty and the reloaded ammunition boxes exit from the bottom of the vertical conveyor 210.

CONCLUSION

It is very clear from all of the foregoing, and from the contents of the Figures of the drawings herein, that the stated principal object, as well as related objects, of our invention has been attained.

It is to be noted that, although there have been described the fundamental and unique features of our inventive automated ammunition loading/downloading system as applied to a particular preferred embodiment for a specific use, various other embodiments, adaptations, substitutions, additions, omissions, and the like may occur to, and may be made by, those of ordinary skill in the art, without departing from the spirit of our invention.

What is claimed is:

1. An automated system for loading and downloading a plurality of identical items from a plurality of identical containers housing said identical items, wherein said system is adapted for use in loading and downloading identical rounds of ammunition from identical standardized containers to an aircraft that is structured and powered by another system to receive and to use live rounds of said ammunition and to reject cartridge cases of spent rounds of said ammunition, comprising:

a. a loader assembly which includes conveyor elements and comprises:

1. a vertical conveyor assembly, which includes an interrupted intermittent motion device, comprising:

a. a rotatable input drive shaft;

b. a primary driver wheel disposed on said input drive shaft, with said primary driver wheel having an internal surface, a locking groove in said internal surface, and a driver roller connected to and protruding from said internal surface:

c. a secondary driver wheel disposed on said input drive shaft, with said secondary driver wheel having an internal surface facing said internal surface of said primary driver wheel, a locking groove in said internal surface, and a driver roller connected to and protruding from said internal surface;

d. a two-sided indexing driven wheel having:

aa. a first side surface facing said internal surface of said primary driver wheel, with said first side surface of said two-sided indexing driven wheel having four adjacent and circumferentially-spaced drive slots therein which are dimensioned and configurated, individually and separately, to accept, engage with, and releasably hold said driver roller of said primary driver wheel, and with said first side surface also having six locking rollers connected to and protruding from said first side surface;

bb. and, a second side surface facing said internal surface of said secondary driver wheel, with said second side surface of said two-sided indexing driven wheel having one drive slot therein dimensioned and configurated to accept, engage with, and releasably hold said driver roller of said secondary driver wheel, and with said second side surface also having two locking rollers connected to and protruding from said second side surface;

e. and, a rotatable output shaft on which is disposed said two-sided indexing driven wheel;

2. an extraction assembly operatively associated with said vertical conveyor assembly;

3. a horizontal conveyor assembly operatively associated with said extraction assembly, wherein said horizontal conveyor assembly comprises:

aa. a housing having a flat table-like upper surface, a lower surface, and two end portions, with each said end portion having an opening configurated and dimensioned to accept and permit the passage therethrough of said cartridges of spent rounds of ammunition;

bb. a plurality of identical individual ammunition round-carrier elements connected in an endless chain fashion;

cc. and, means for moving, in an endless chain manner, said individual round-carrier elements across said flat table-like upper surface, said end portions, said end openings, and said lower surface of said housing;

whereby said cartridges of spent ammunition rounds fall through said openings in said end portions of said horizontal conveyor assembly housing;

4. and, a reloading assembly operatively associated with said horizontal conveyor assembly;

b. means for housing said conveyor elements, wherein said conveyor elements housing means has a first open end and a second open end, with said first open end in communication with said loader assembly, and wherein said conveyor elements housing means includes flexible chuting having a first open end and a second open end;

c. and, a loader assembly/aircraft interface unit in communication with said open end of said conveyor elements housing means, and also simultaneously in communication with the other system in the aircraft.

2. An interrupted intermittent motion device, as set forth in claim 1, wherein:

a. said first side surface of said two-sided indexing driven wheel has four adjacent and circumferentially-spaced drive slots and six locking rollers;

b. and, said second side surface of said two-sided indexing driven wheel has one drive slot and two locking rollers.

3. An interrupted intermittent motion device, as set forth in claim 2, wherein:

a. said four adjacent and circumferentially-spaced drive slots on said first side surface of said two-sided indexing driven wheel are each separated from adjacent drive slots by an angular measurement of 72°;

b. and, said one drive slot on said second side surface of said two-sided indexing driven wheel is separated by adjacent drive slots on said first side surface of said two-sided indexing driven wheel by an angular measurement of 72°.

4. An extraction assembly, as set forth in claim 3, which includes an extractor-release assembly comprising:

a. a plurality of extractor-release mechanisms, wherein each of said plurality of extractor-release mechanisms is identical and includes:

1. a support shaft;
2. a cylindrical body attached to said support shaft;
3. a plurality of finger-like grasping elements having a first end, a middle portion, and a second end, with the first end having a hook-like projection, the middle portion pivotally connected to said cylindrical body, and the second end biased to said support shaft;
4. an actuation lever having a first end, a middle portion, and a second end, with said middle portion pivotally connected to said support shaft;
5. and, at least one finger-like slide element having a first end and a second end, with said second end pivotally connected to said first end of said actuation lever, and with said finger-like slide element abutting with and slida-ly movable along said cylindrical body;

b. a movable extractor bar to which each of said plurality of extractor-release mechanisms are mounted in a side-by-side relationship;

c. means for moving said extractor bar;

d. means for causing said extractor-release mechanisms to extract and to release;

e. and, an extractor-release table disposed below said plurality of extractor-release mechanisms, with said table having a drop-off section.

5. An extractor-release assembly, as set forth in claim 4, wherein each of said plurality of extractor-release mechanisms comprises:

a. two finger-like grasping elements;

b. and, two finger-like slide elements.

6. An extractor-release assembly as set forth in claim 4, wherein said means for causing said extractor-release mechanisms to extract and release includes an extractor roller, to the rear of and above said extractor bar, positioned at a height at which said actuation levers will strike the extractor roller.

* * * * *